United States Patent [19]

Yonker

[11] 3,948,405

[45] Apr. 6, 1976

[54] LINERLESS CONTAINER CLOSURE

[75] Inventor: Charles R. Yonker, Palos Heights, Ill.

[73] Assignee: VCA Corporation, Baton Rouge, La.

[22] Filed: Feb. 11, 1975

[21] Appl. No.: 549,004

[52] U.S. Cl. ..... 215/344; 215/DIG. 1

[51] Int. Cl.[2] ..... B65D 53/00

[58] Field of Search ..... 215/344, 341, DIG. 1

[56] References Cited

UNITED STATES PATENTS

| | | | |
|---|---|---|---|
| 3,203,571 | 8/1965 | Plunkett | 215/344 |
| 3,339,773 | 9/1967 | Stull | 215/344 |
| 3,784,041 | 1/1974 | Birch | 215/344 |

*Primary Examiner*—George T. Hall

*Attorney, Agent, or Firm*—Donald L. Johnson; John F. Sieberth; E. Donald Mays

[57] ABSTRACT

A one-piece, linerless, plastic cap for a container. The cap includes an annular top wall section and an integral, generally cylindrical skirt section depending from the top wall. The interior wall of the skirt portion of the cap may be provided with threads for attachment to the threaded neck of a container or with an annular, inwardly projecting bead adapted to be received in a recess in the neck of a container. An integral, flexible, annular sealing ring projects inwardly and downwardly from the underside of the top wall section of the cap and is adapted to make sealing contact with the rim of the neck portion of the container when the cap is secured to the container neck.

2 Claims, 6 Drawing Figures

LINERLESS CONTAINER CLOSURE

BACKGROUND OF THE INVENTION

1. Field of the Invention

This invention relates to a cap for containers having a cylindrical neck, which cap does not require a separate liner to form a liquidtight seal with the rim of the container.

2. Description of the Prior Art

Closures for containers such as bottles or cans having a cylindrical neck have conventionally employed a separate liner made from cardboard, plastic, cork, etc., inside the cap in order to achieve a liquidtight seal between the cap and the mouth or rim of the container neck. Fabrication and insertion of liners into caps require expensive equipment and result in additional costs in assembling the complete cap.

Molded plastic caps have replaced to a substantial extent the metal caps formerly used in sealing containers. In order to overcome the objections inherent in the use of plastic caps with liners, the prior art has proposed a number of constructions for one-piece, plastic caps wherein an integrally formed sealing ring or gasket structure is provided in the upper interior end of the cap. Unfortunately, very few of the proposed, one-piece, linerless caps of the prior art have found acceptance in the marketplace. Many of the proposed linerless caps have complex construction requiring intricate injection molding dies for their production. Additionally, many of the prior art linerless plastic caps have been adapted for use only on bottles having special neck constructions.

Therefore, it can be seen that there is a real need in the marketplace for a simple, economical, readily manufactured, one-piece, linerless plastic cap which obviates the many disadvantages found heretofore in the prior art linerless caps.

SUMMARY OF THE INVENTION

It is an object of the present invention to provide a one-piece, linerless, plastic cap which makes a secure and liquidtight seal with the container.

It is a further object of the present invention to provide a one-piece, linerless, plastic cap which can be economically manufactured using conventional injection molding techniques.

It is still another object of the present invention to provide a one-piece, linerless, plastic cap which will maintain a liquidtight seal under various conditions.

Other objects and advantages of the present invention will be readily apparent from the drawings and the following description.

The above and other objects of the present invention are realized in a one-piece, linerless, plastic cap for a container having a generally cylindrical neck portion. The cap has an annular, top wall section and an integral, generally cylindrical skirt section depending from the top wall section. Engaging means are provided on the interior wall of the skirt portion adapted to engage retaining means provided on the exterior wall of the neck portion of the container. An integral, flexible, annular, sealing ring is provided having its proximate end integrally attached to the underside of the top wall section of the cap adjacent its intersection with the inner wall of the skirt section and its distal end projecting downwardly and inwardly. The sealing ring is adapted to make sealing contact with the rim or mouth of the neck portion of the container when the cap is secured to the container neck.

DESCRIPTION OF THE PREFERRED EMBODIMENTS

Figure 1:
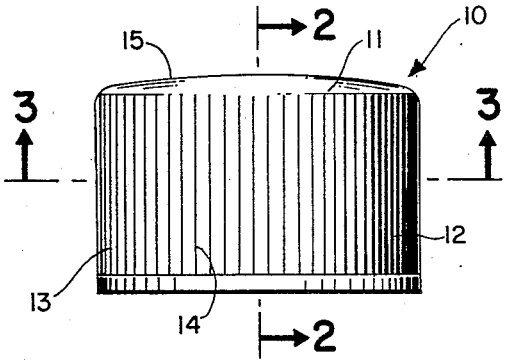
FIG. 1 is an elevational view of a linerless cap constructed in accordance with the present invention.
Figure 2:
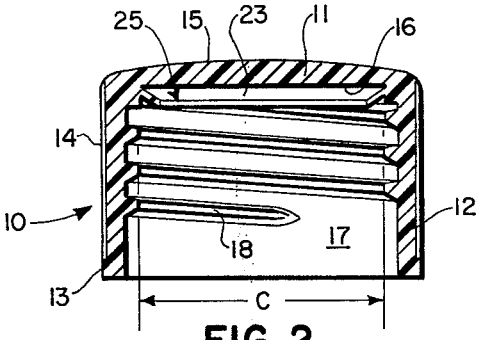
FIG. 2 is a transverse, sectional view of the cap of FIG. 1 along line 2—2.
Figure 3:
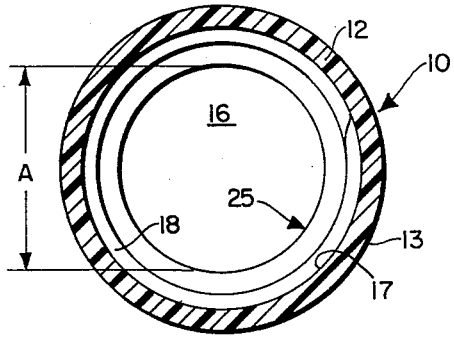
FIG. 3 is a bottom plan view of the cap of FIG. 1.
Figure 4:
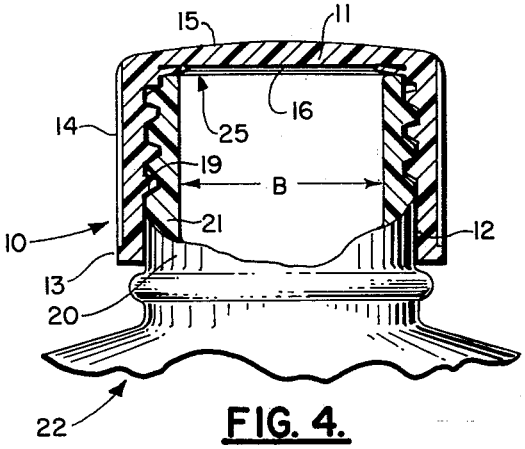
FIG. 4 is a transverse, sectional, partially broken view of the cap of FIG. 1 attached to a container.

Referring now to FIGS. 1–4, a linerless, one-piece, plastic cap of the present invention, designated generally by the numeral 10, includes an annular top wall section 11 and an integral, generally cylindrical skirt section 12 depending from the top section 11 of the cap. The outer wall 13 of the skirt section may be provided with a plurality of vertically extending ribs 14, if desired, to facilitate easy removal of the cap. The top surface 15 of the top wall section of the cap, as seen in FIGS. 1, 2 and 4, is generally slightly domed or convex in shape, although it is understood that the surface 15 may be flat or any other suitable shape, if desired. The bottom surface 16 of the top wall section of the cap is preferably planar, at least in the annular portion adjacent its juncture with the cylindrical skirt section 12 of the cap. The inner wall 17 of the skirt section 12 is depicted as being cylindrical in shape; however, it is understood that the inner wall may be conical or any other suitable shape. An inwardly projecting cap thread 18 is integrally formed on the inner wall 17 of the skirt section. The cap thread 18 is received in a spiral groove 19 formed in the outer wall 20 of the cylindrical neck 21 of a bottle 22 or other container.

Figure 5:
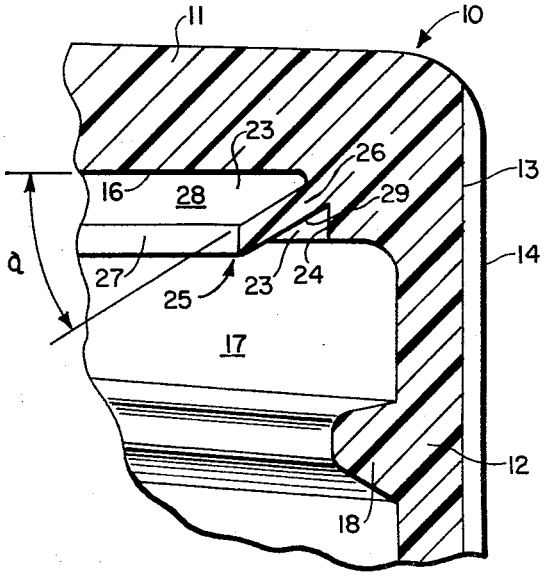
FIG. 5 is an enlarged, partially broken, transverse, sectional view of a portion of the cap as seen in FIG. 2.

Referring now to FIGS. 2 and 5, a cylindrical recess 23 is provided in the bottom of the top wall section of the cap and is defined by the downwardly facing bottom surface 16 of the top wall section of the cap and an inwardly facing, annular shoulder 24. An integrally formed, flexible, inwardly and downwardly projecting sealing ring, designated generally 25, has its proximate end 26 integrally formed with and attached to the underside of the cap at the juncture of the planar bottom surface 16 and the annular shoulder 24. The distal end of the sealing ring is defined by an inwardly facing, generally flat, annular surface 27 which defines an annular opening having a diameter A (as seen in FIG. 3). The upper sidewall 28 of the sealing ring has an annular flat surface which merges into the bottom surface 16 of the top wall section in a radiused juncture, as can be seen more clearly in FIG. 5. The lower sidewall 29 of the sealing ring has a flat, annular surface which is parallel to the upper sidewall 28 and merges into the inwardly facing, annular shoulder 24 at an acute angle. Thus, the sealing fin 25 has substantially uniform thickness throughout its length except at its proximate end where it joins the underside of the bottle cap. The upper sidewall 28 and lower sidewall 29 of the sealing ring 25 are directed downwardly and inwardly from the planar, transverse surface 16 of the underside of the cap at an angle alpha of from about 30 to about 45 degrees as seen in FIG. 5. When the sealing fin is in its relaxed, normal position, it has a shape approximating the shape of a section of a hollow cone.

Figure 6:
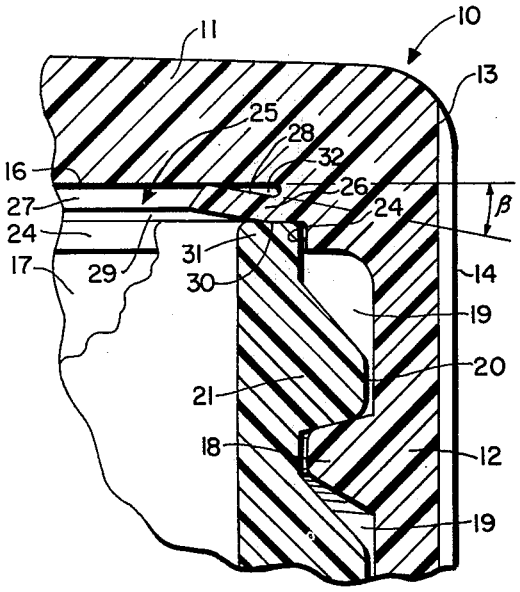
FIG. 6 is a view similar to FIG. 5 with the cap attached to the neck of the container.

In operation, the cap 10 is placed on the bottle neck 20 and rotated to engage the threads. As the cap is screwed down on the neck of the container, the mouth, or rim, 30 of the container neck 21 will contact the underside 29 of the sealing ring 25 with the inner edge of the rim making first contact. As further torque is applied to the cap, the upper extremity 31 of the neck of the container neck 21 is received in the annular recess 23, and the distal end of the annular sealing ring 25 is forced upwardly until it contacts the undersurface 16 of the bottom wall section of the cap. The cap 10 is torqued onto the container neck 21 until a portion of the lower sidewall 29 of the sealing ring is in substantially flush engagement with the mouth, or rim, 30 of the container neck, as seen in FIG. 6. When in this fully sealed position, the distal end of the ring abuts the bottom surface 16 of the cap top wall section and the upper sidewall 28 of the web forms an angle beta with the underside 16 of the cap top section. Angle beta is generally in the range of from about 5 to about 15 degrees. Because of the radiused juncture of the top wall 28 of the sealing ring with the bottom surface 16 when the sealing ring is in the position shown in FIG. 6, an annular air-filled, hollow space 32 is provided between these surfaces.

For proper cooperation between the sealing ring 25 on the cap and the upper end 31 of the neck 21 of the bottle, the inside diameter B of the neck 21, as seen in FIG. 4, should be greater than the diameter A of the opening in the sealing ring whereby the distal end 27 of the sealing ring will project downwardly and inwardly into the hollow of the neck portion of the bottle when the cap is initially threaded onto the neck of the container. The diameter of the cylindrical recess 23 should be slightly greater than the outside diameter of the upper end 31 of the container neck whereby the upper end portion 31 of the neck will be received within the annular recess 23. While the thickness of the sealing ring 25 will be determined to some extent by the properties of the plastic material from which the cap is made, it is preferred that the ring be made sufficiently thick so that the radiused juncture point of the top surface 27 thereof with the underside 16 of the cap will lie within the thickness of the wall of the upper end 31 of the container neck as seen in FIG. 6. When the foregoing construction is utilized, the outer, annular portion of the rim, or mouth, 30 of the container compresses the plastic material at the proximate end 26 of the ring to effect a seal while the spring-fulcrum action exerted by the remainder of the sealing ring seals the inner, annular portion of the mouth, or rim, 30 of the container against an intermediate, annular portion of the lower sidewall 29, thereby obtaining a double function, liquidtight seal.

The cap of the present invention may be constructed from any number of suitable plastic materials by injection molding or other suitable means. Among suitable thermoplastic materials are polymers and/or copolymers of ethylene, propylene, vinyl chloride, vinyl acetate, or ABS plastics, polycarbonates, nylons, thermoplastic polyesters, and other commercially available thermoplastic materials having the necessary degree of flexibility and combination of rigidity to provide the proper stiffness for the cap top and skirt sections, yet having sufficient flexibility whereby the sealing ring will make good sealing engagement with the mouth, or rim, of the container neck.

While the cap of the present invention has been described and illustrated as utilizing a threaded engagement with the container neck, it is to be understood that the cap of the present invention, if desired, may be produced wherein a crown or snap-on type closure is utilized, i.e., instead of threads an inwardly extending, annular bead at the lower end of the skirt is provided which is received in an annular recess provided in the container neck. For example, see the snap-on type closure and container shown in FIG. 5 of U.S. Pat. No. 3,067,900.

While the bottle 22 of the drawings is shown as plastic, it is understood that the linerless, one-piece, plastic cap of this invention may be utilized on any type of container having a generally cylindrical neck, e.g., bottles or cans made from glass, plastic, or metal.

While adequate description of the preferred embodiments of the present invention has been shown and described for purposes of illustrating the invention, it will be readily apparent to those skilled in the closure art that numerous changes and modifications may be made to the linerless, plastic cap of the present invention without departing from the spirit and scope of the invention.

What is claimed is:

1. A one-piece, linerless, plastic cap for a container having a generally cylindrical neck portion comprising:

a. an annular top wall portion, said top wall having a shallow cylindrical recess in the underside thereof, said recess defined by a planar bottom wall and an inwardly facing, cylindrical shoulder;

b. an integral, generally cylindrical skirt section depending from said top wall section, said skirt section joining said top wall section outwardly of said cylindrical recess thereby providing a downwardly facing shoulder portion on said sidewall interior;

c. engaging means on the interior wall of said skirt portion adapted to engage retaining means provided on the exterior wall of said neck portion of said container;

d. a single, integral, flexible, annular, sealing ring provided on the underside of said top wall and having its proximate end integrally attached to said top wall section at the intersection of said planar bottom wall and said inwardly facing cylindrical shoulder and its distal end projecting downwardly and inwardly, said ring making sealing contact with the rim of said neck portion and the upper end of said neck portion being closely received within the lower portion of said cylindrical recess when said cap is secured to said container neck.

2. In the plastic cap of claim 1 wherein said cylindrical recess has a diameter only slightly larger than the outside diameter of said neck portion.

* * * * *